US008042913B2

(12) United States Patent
Nathan et al.

(10) Patent No.: US 8,042,913 B2
(45) **Date of Patent: *Oct. 25, 2011**

(54) FLUID EJECTION DEVICE WITH DEFLECTIVE FLEXIBLE MEMBRANE

(75) Inventors: Roi Nathan, Haifa (IL); Gil Fisher, Netanya (IL); Haggai Karlinski, Netanya (IL); Aya Blumberg, Netanya (IL); Ilan Weiss, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1314 days.

This patent is subject to a terminal disclaimer.

(21) Appl. No.: 11/520,876

(22) Filed: Sep. 14, 2006

(65) Prior Publication Data

US 2008/0068425 A1 Mar. 20, 2008

(51) Int. Cl.
*B41J 2/045* (2006.01)

(52) U.S. Cl. ..... 347/68; 347/94; 347/70; 347/71; 347/72

(58) Field of Classification Search ..... 347/68–72, 347/49, 94
See application file for complete search history.

(56) References Cited

U.S. PATENT DOCUMENTS

| | | | | |
|---|---|---|---|---|
| 4,364,066 | A | 12/1982 | Koto | |
| 4,418,355 | A | 11/1983 | DeYoung et al. | |
| 4,459,601 | A | 7/1984 | Howkins | |
| 4,578,686 | A | 3/1986 | Vollert | |
| 4,688,048 | A | 8/1987 | Uematsu et al. | |
| 4,697,193 | A | 9/1987 | Howkins | |
| 4,716,418 | A | 12/1987 | Heinzl et al. | |
| 4,835,554 | A | 5/1989 | Hoisington et al. | |
| 4,882,595 | A | 11/1989 | Trueba et al. | |
| 5,289,209 | A | 2/1994 | Suzuki et al. | |
| 5,396,042 | A | 3/1995 | Ishida et al. | |
| 5,463,413 | A | 10/1995 | Ho et al. | |
| 5,751,317 | A | 5/1998 | Peeters et al. | |
| 5,751,320 | A | 5/1998 | Scheffelin et al. | |
| 5,761,783 | A * | 6/1998 | Osawa et al. | 29/25.35 |
| 5,793,393 | A | 8/1998 | Coven | |
| 5,912,685 | A | 6/1999 | Raman | |
| 5,946,012 | A | 8/1999 | Courian et al. | |
| 6,042,222 | A | 3/2000 | Moritz, III et al. | |
| 6,048,052 | A * | 4/2000 | Kitahara et al. | 347/70 |
| 6,109,744 | A | 8/2000 | Nishimura | |
| 6,234,613 | B1 | 5/2001 | Feinn et al. | |
| 6,254,222 | B1 | 7/2001 | Murata et al. | |
| 6,254,223 | B1 | 7/2001 | Kim et al. | |
| 6,409,316 | B1 | 6/2002 | Clark et al. | |
| 6,416,680 | B1 * | 7/2002 | Mitsuzawa et al. | 216/27 |
| 6,443,564 | B1 | 9/2002 | Keil et al. | |
| 6,502,930 | B1 * | 1/2003 | Shimada et al. | 347/71 |
| 6,719,404 | B2 | 4/2004 | Kobayashi | |

(Continued)

FOREIGN PATENT DOCUMENTS

| | | |
|---|---|---|
| JP | 60262659 | 12/1985 |

(Continued)

*Primary Examiner* — Matthew Luu
*Assistant Examiner* — Henok Legesse

(57) ABSTRACT

A fluid ejection device includes a substrate having a fluid channel, a flexible membrane supported by the substrate and extended a length of the fluid channel, an actuator provided on a first portion of the flexible membrane, and a reinforcement member provided on a second portion of the flexible membrane such that the actuator is adapted to deflect the first portion of the flexible membrane relative to the fluid channel, and the reinforcement member supports the second portion of the flexible membrane.

29 Claims, 5 Drawing Sheets

U.S. PATENT DOCUMENTS

| | | | | |
|---|---|---|---|---|
| 6,824,253 | B2 | 11/2004 | Hoisington et al. | |
| 6,966,635 | B2 * | 11/2005 | Miyata et al. | 347/70 |
| 7,651,204 | B2 * | 1/2010 | Nathan et al. | 347/71 |
| 2003/0117463 | A1 | 6/2003 | Kitahara | |
| 2003/0222945 | A1 * | 12/2003 | Nagata et al. | 347/68 |
| 2004/0141032 | A1 | 7/2004 | Matsuzawa et al. | |
| 2005/0134652 | A1 | 6/2005 | Iwashita et al. | |
| 2005/0140746 | A1 | 6/2005 | Sakamoto et al. | |
| 2005/0185025 | A1 * | 8/2005 | Shimada et al. | 347/68 |
| 2005/0248628 | A1 | 11/2005 | Isono | |
| 2006/0187274 | A1 * | 8/2006 | Machida et al. | 347/70 |
| 2008/0068430 | A1 * | 3/2008 | Nathan et al. | 347/94 |

FOREIGN PATENT DOCUMENTS

| | | |
|---|---|---|
| JP | 61 063456 A | 4/1986 |
| JP | 1991-266645 | 11/1991 |
| JP | 06270407 | 9/1994 |

* cited by examiner

FLUID EJECTION DEVICE WITH DEFLECTIVE FLEXIBLE MEMBRANE

CROSS-REFERENCE TO RELATED APPLICATIONS

This application is related to U.S. patent application Ser. No. 11/520,883, filed on even date herewith, assigned to the assignee of the present invention, and incorporated herein by reference, and is related to U.S. patent application Ser. No. 11/520,877, filed on even date herewith, assigned to the assignee of the present invention, and incorporated herein by reference.

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

One type of printhead includes a piezo-actuated printhead. The piezo-actuated printhead includes a substrate defining a fluid chamber, a flexible membrane supported by the substrate over the fluid chamber, and an actuator provided on the flexible membrane. In one arrangement, the actuator includes a piezoelectric material which deforms when an electrical voltage is applied. As such, when the piezoelectric material deforms, the flexible membrane deflects thereby causing ejection of fluid from the fluid chamber and through an orifice communicated with the fluid chamber. Fabrication and operation of such printheads present various challenges. For these and other reasons, there is a need for the present invention.

SUMMARY

One aspect of the present invention provides a fluid ejection device. The fluid ejection device includes a substrate having a fluid channel, a flexible membrane supported by the substrate and extended a length of the fluid channel, an actuator provided on a first portion of the flexible membrane, and a reinforcement member provided on a second portion of the flexible membrane such that the actuator is adapted to deflect the first portion of the flexible membrane relative to the fluid channel, and the reinforcement member supports the second portion of the flexible membrane.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
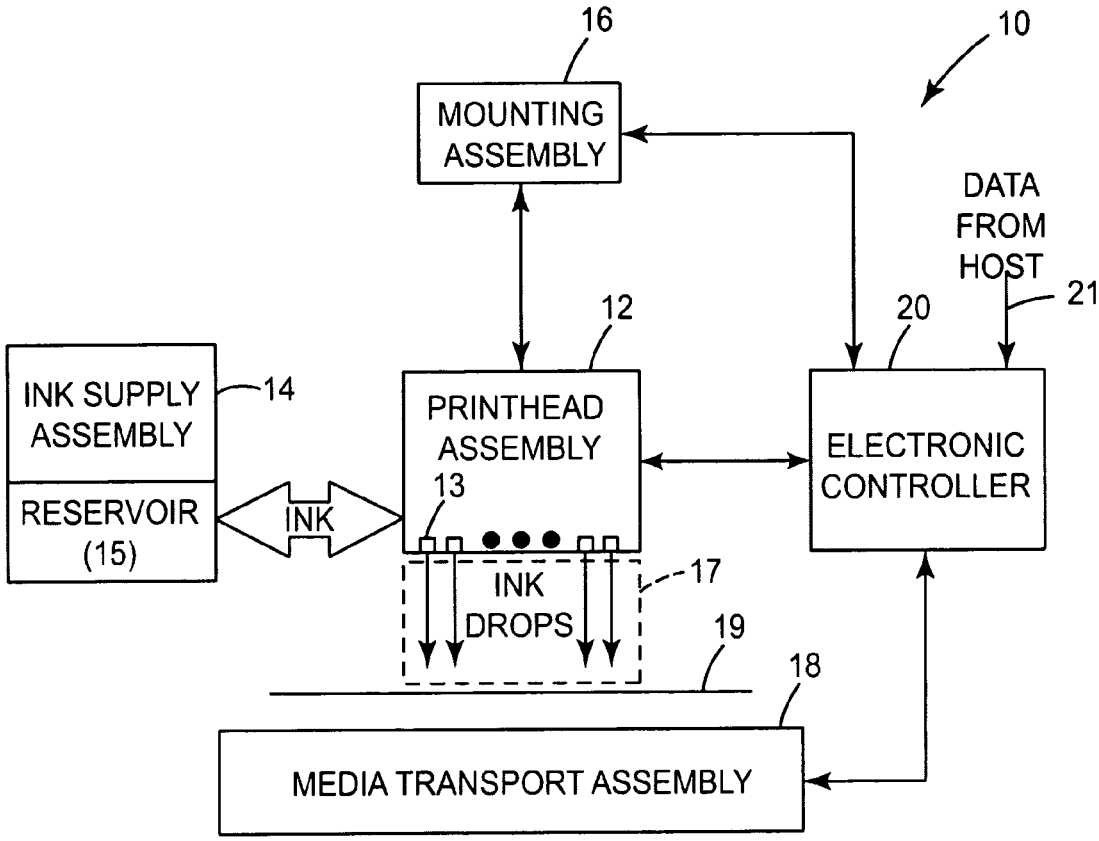
FIG. 1 is block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
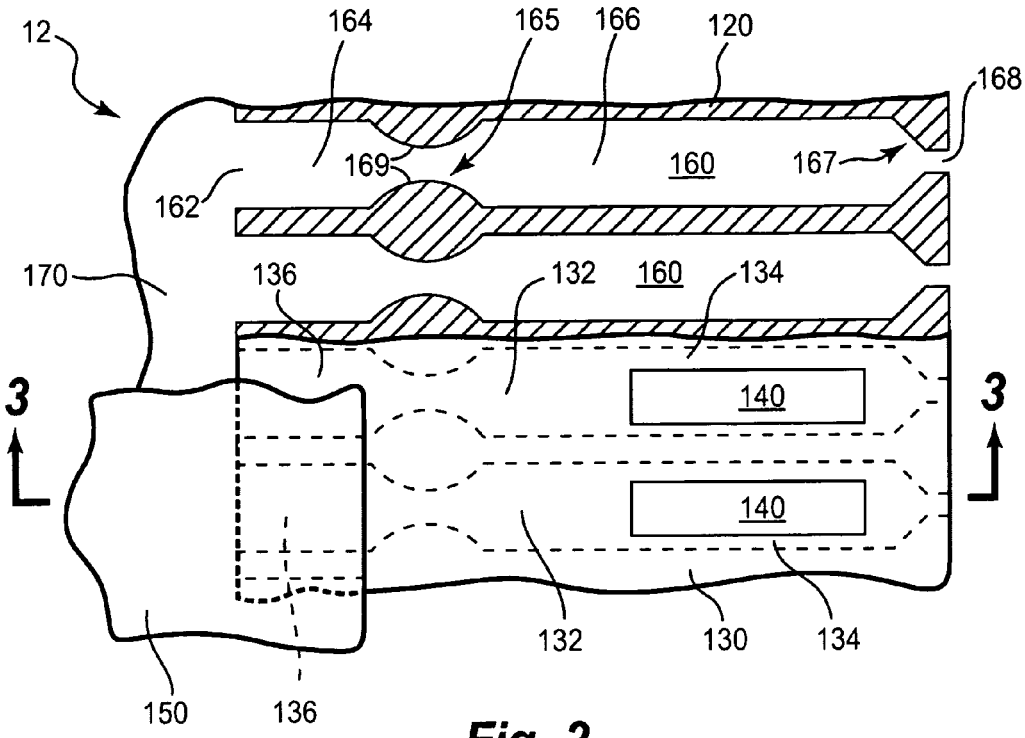
FIG. 2 is a schematic view illustrating one embodiment of a portion of a printhead assembly according to the present invention.
Figure 3:
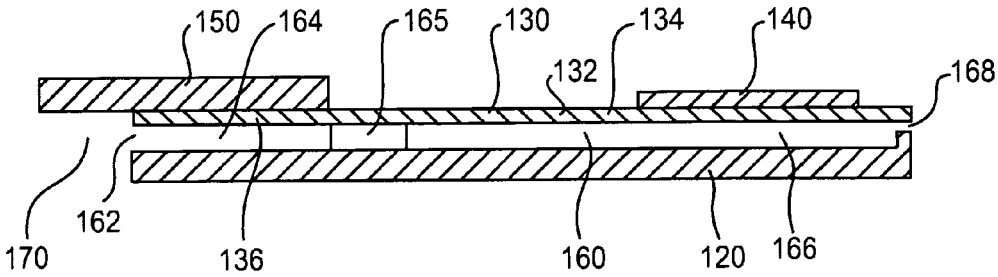
FIG. 3 is a schematic cross-sectional view illustrating one embodiment of a portion of the printhead assembly of FIG. 2.
Figure 4:
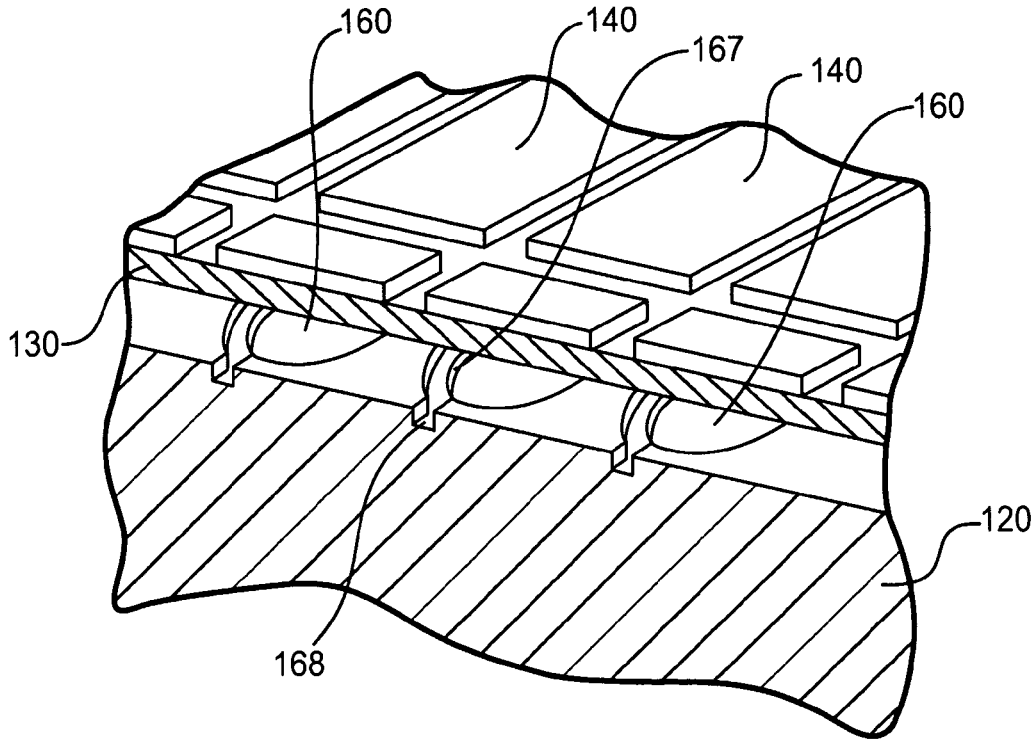
FIG. 4 is a schematic, exploded perspective view illustrating one embodiment of a portion of a printhead assembly according to the present invention.

FIGS. 2-4 illustrate one embodiment of a portion of printhead assembly 12. Printhead assembly 12, as one embodiment of a fluid ejection device, includes a substrate 120, a flexible membrane 130, actuators 140, and a reinforcement member 150. Substrate 120, flexible membrane 130, actuators 140, and reinforcement member 150 are arranged and interact, as described below, to eject drops of fluid from printhead assembly 12.

In one embodiment, substrate 120 has a plurality of fluid channels 160 defined therein. Fluid channels 160 communicate with a supply of fluid and, in one embodiment, each include a fluid inlet 162, a fluid plenum 164, a fluid ejection chamber 166, and a fluid outlet 168. As such, fluid plenum 164 communicates with fluid inlet 162, fluid ejection chamber 166 communicates with fluid plenum 164, and fluid outlet 168 communicates with fluid ejection chamber 166. In one embodiment, fluid inlet 162, fluid plenum 164, fluid ejection chamber 166, and fluid outlet 168 are coaxial. In embodiment, fluid channels 160 have a substantially rectangular profile with fluid plenum 164 and fluid ejection chamber 166 each being formed by parallel sidewalls.

In one embodiment, substrate 120 is silicon substrate and fluid channels 160 are formed in substrate 120 using photolithography and etching techniques.

In one embodiment, a supply of fluid is distributed to and communicated with fluid inlet 162 of each fluid channel 160 via a fluid supply passage 170. In one embodiment, fluid supply passage 170 is a single or common fluid supply passage communicated with fluid inlet 162 of each fluid channel 160. As such, fluid is distributed from fluid supply passage 170 through fluid inlet 162 to plenum 164, and through fluid plenum 164 to fluid ejection chamber 166 of each fluid channel 160. In one embodiment, fluid outlet 168 of each fluid channel 160 forms a fluid nozzle or orifice of printhead assembly 12 such that fluid is ejected from fluid ejection chamber 166 through fluid outlet/nozzle 168, as described below.

In one embodiment, fluid channels 160 each include a constriction 165. In one embodiment, constriction 165 is formed by a narrowing of each fluid channel 160 between fluid plenum 164 and fluid ejection chamber 166. More specifically, in one embodiment, a width of fluid channel 160 at constriction 165 is less than a width of fluid channel 160 along fluid plenum 164 and along fluid ejection chamber 166. Thus, in one embodiment, constriction 165 forms a neck in each fluid channel 160 between fluid plenum 164 and fluid ejection chamber 166.

In one embodiment, constriction 165 of each fluid channel 160 is formed by a pair of opposing projections 169 projecting into each fluid channel 160. In one embodiment, a height of projections 169 is substantially equal to a depth of fluid channels 160. Thus, in one embodiment, as described below, projections 169 and, therefore, constriction 165 contact flexible membrane 130 and provide support for flexible membrane 130 between fluid plenum 164 and fluid ejection chamber 166. The shape and size of projections 169 can vary, for example, from an arcuate-like shape, such as that illustrated, to a trapezoid-like shape or other hydrodynamic favorable shape providing sufficient mechanical support for flexible membrane 130.

In one embodiment, a width of constriction 165 and, therefore, a width of projections 169, is selected so as to not substantially affect characteristics such as drop velocity and drop size of drops ejected from fluid channels 160. In one exemplary embodiment, a depth of fluid channels 160 is approximately 90 microns, a width of fluid channels 160 is in a range of approximately 300 microns to approximately 600 microns, and a width of each projection 169 (measured perpendicular to a sidewall of fluid channels 160) is approximately 100 microns.

In one embodiment, fluid channels 160 each include a convergence 167. In one embodiment, convergence 167 is provided between fluid ejection chamber 166 and fluid outlet 168. As such, convergence 167 directs fluid from fluid ejection chamber 166 to fluid outlet 168. Convergence 167, therefore, forms a fluid or flow converging structure. During operation of printhead assembly 12, convergence 167 reduces potential turbulence which may be generated if fluid channels 160 were formed only by right angles. In addition, convergence 167 prevents air ingestion into fluid outlet 168.

In one embodiment, as illustrated in FIG. 2, convergence 167 is formed by two facets each extending at an angle of approximately 45 degrees from sidewalls of fluid ejection chamber 166 and converging towards fluid outlet 168. In another embodiment, as illustrated in FIG. 4, convergence 167 is formed by arcuate sections extending from sidewalls of fluid ejection chamber 166 towards fluid outlet 168.

As illustrated in the embodiments of FIGS. 2-4, flexible membrane 130 is supported by substrate 120 and extends over fluid channels 160. In one embodiment, flexible membrane 130 is a single membrane extended over multiple fluid channels 160. In one embodiment, flexible membrane 130 extends a length of fluid channels 160. As such, flexible membrane 130 extends from fluid inlet 162 to fluid outlet 168 of each fluid channel 160.

In one embodiment, flexible membrane 130 includes flexible membrane portions 132 each defined over one fluid channel 160. In one embodiment, each flexible membrane portion 132 extends a length of a respective fluid channel 160. As such, each flexible membrane portion 132 includes a first portion 134 extended over fluid ejection chamber 166 and a second portion 136 extended over fluid plenum 164. Thus, first portion 134 of flexible membrane portions 132 extends in a first direction from constriction 165 of fluid channels 160, and second portion 136 of flexible membrane portions 132 extends in a second direction opposite the first direction from constriction 165 of fluid channels 160.

In one embodiment, with flexible membrane portions 132 each extending a length of a respective fluid channel 160, flexible membrane portions 132 are each supported along a respective fluid channel 160 at a first location adjacent fluid outlet 168 and at a second location between or intermediate of fluid inlet 162 and fluid outlet 168. For example, as described above, flexible membrane portions 132 are each supported between fluid inlet 162 and fluid outlet 168 by constriction 165. More specifically, flexible membrane portions 132 are each supported by constriction 165 provided between fluid plenum 164 and fluid ejection chamber 166 of a respective fluid channel 160. Constriction 165, therefore, supports flexible membrane portions 132 between fluid plenum 164 and fluid ejection chamber 166.

In one embodiment, flexible membrane 130 is formed of a flexible material such as, for example, a flexible thin film of silicon nitride or silicon carbide, or a flexible thin layer of silicon. In one exemplary embodiment, flexible membrane 130 is formed of glass. In one embodiment, flexible membrane 130 is attached to substrate 120 by anodic bonding or similar techniques.

As illustrated in the embodiments of FIGS. 2-4, actuators 140 are provided on flexible membrane 130. More specifically, each actuator 140 is provided on first portion 134 of a respective flexible membrane portion 132. In one embodiment, actuators 140 are provided or formed on a side of flexible membrane 130 opposite fluid channels 160. As such, actuators 140 are not in direct contact with fluid contained within fluid channels 160. Thus, potential affects of fluid contacting actuators 140, such as corrosion or electrical shorting, are reduced.

In one embodiment, actuators 140 include a piezoelectric material which changes shape, for example, expands and/or contracts, in response to an electrical signal. Thus, in response to the electrical signal, actuators 140 apply a force to respective flexible membrane portions 132 which cause flexible membrane portions 132 and, more specifically, first portion 134 of flexible membrane portions 132 to deflect. Examples of a piezoelectric material include zinc oxide or a piezoceramic material such as barium titanate, lead zirconium titanate (PZT), or lead lanthanum zirconium titanate (PLZT). It is understood that actuators 140 may include any type of device which causes movement or deflection of flexible membrane portions 132 including an electrostatic, magnetostatic, and/or thermal expansion actuator.

In one embodiment, as illustrated in FIG. 4, actuators 140 are formed from a single or common piezoelectric material. More specifically, the single or common piezoelectric material is provided on flexible membrane 130, and selective portions of the piezoelectric material are removed such that the remaining portions of the piezoelectric material define actuators 140.

In one embodiment, as described below, actuators 140 deflect flexible membrane portions 132 and, more specifically, first portion 134 of flexible membrane portions 132. Thus, when flexible membrane portions 132 of flexible membrane 130 deflect, droplets of fluid are ejected from a respective fluid outlet 168.

As illustrated in the embodiments of FIGS. 2 and 3, reinforcement member 150 is provided on flexible membrane 130 and extends over fluid channels 160. More specifically, reinforcement member 150 is provided on second portion 136 of flexible membrane portions 132 and extends over fluid plenum 164 of fluid channels 160. In one embodiment, reinforcement member 150 is provided on a side of flexible membrane 130 opposite of fluid channels 160. As such, reinforcement member 150 supports second portion 136 of flexible membrane portions 132 over fluid plenum 164 of fluid channels 160. More specifically, reinforcement member 150 supports or stiffens second portion 136 of flexible membrane portions 132 such that deflection or oscillation of second portion 136 of flexible membrane 130 is reduced or prevented during operation of printhead assembly 12.

In one embodiment, reinforcement member 150 extends beyond flexible membrane 130 and beyond fluid inlet 162 of fluid channels 160. As such, reinforcement member 150 extends over fluid supply passage 170. Thus, in one embodiment, reinforcement member 150 forms or defines a portion or boundary of fluid supply passage 170. In one embodiment, reinforcement member 150 is a single member supporting second portions 136 of multiple flexible membrane portions 132.

Figure 5:
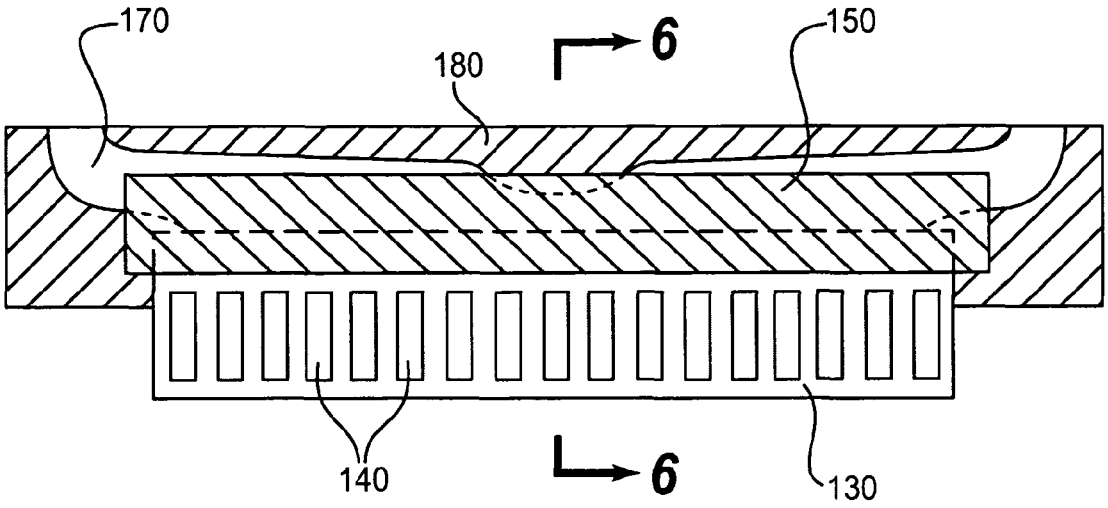
FIG. 5 is schematic view illustrating one embodiment of a portion of a printhead assembly according to the present invention.
Figure 6:
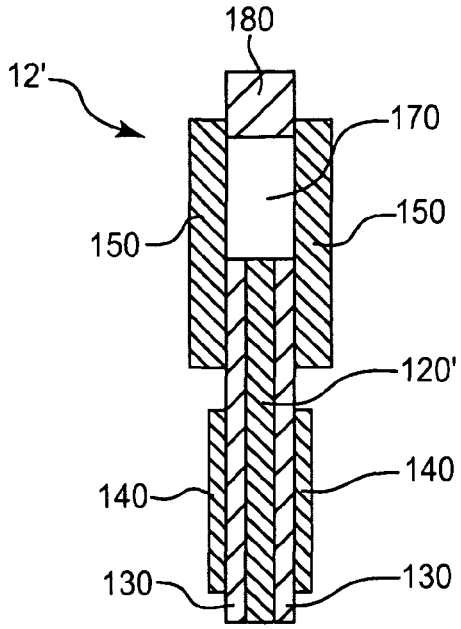
FIG. 6 is a schematic cross-sectional view illustrating one embodiment of a portion of the printhead assembly of FIG. 5.

FIGS. 5 and 6 illustrate another embodiment of printhead assembly 12. In the embodiment of FIGS. 5 and 6, printhead assembly 12' includes substrate 120', flexible membranes 130 provided on opposite sides of substrate 120', actuators 140 provided on flexible membranes 130, reinforcement members 150 provided on flexible membranes 130, and fluid supply passage 170 defined in a supporting structure 180.

Substrate 120' includes fluid channels similar to fluid channels 160, as illustrated and described above, which are formed on a first side and a second side, and which communicate with fluid supply passage 170. In addition, flexible membranes 130 are provided on and supported by the first side and the second side of substrate 120', similar to that illustrated and described above with reference to flexible membranes 130 and substrate 120. Furthermore, actuators 140 are provided on flexible membranes 130, as illustrated and described above, and reinforcement members 150 are provided on flexible membranes 130, as illustrated and described above.

In one embodiment, substrate 120', flexible membranes 130, actuators 140, and reinforcement members 150 are joined to supporting structure 180 at reinforcement members 150 so as to communicate with and, in one embodiment, further define fluid supply passage 170. Thus, reinforcement members 150 facilitate attachment to supporting structure 180. As such, the arrangement of printhead assembly 12' provides two columns of fluid nozzles or orifices for ejection of fluid.

Figure 7A:
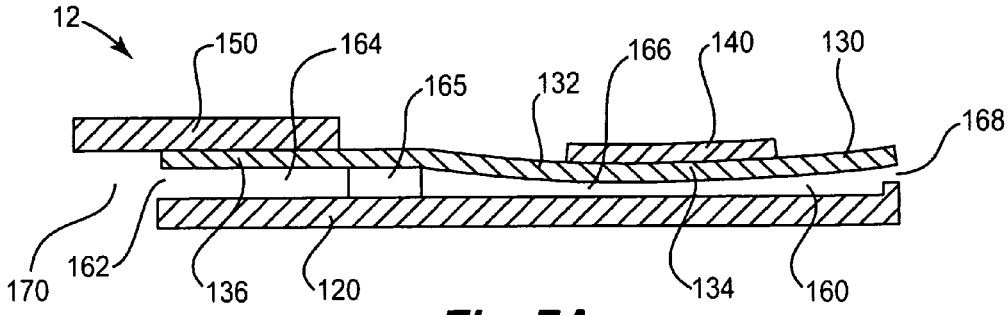
FIGS. 7A-7C are schematic cross-sectional views illustrating one embodiment of operation of a printhead assembly according to the present invention.
Figure 7B:
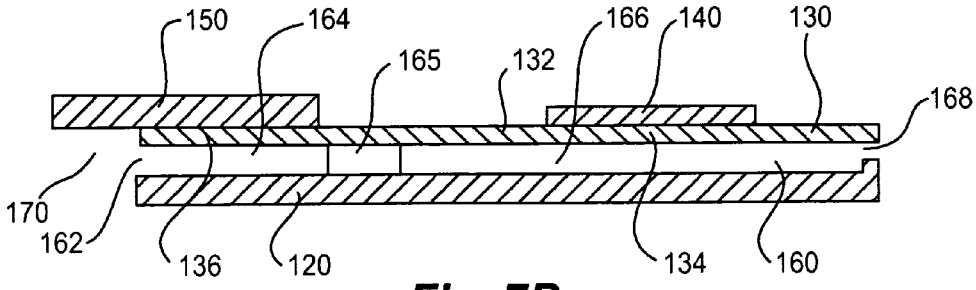
Figure 7C:
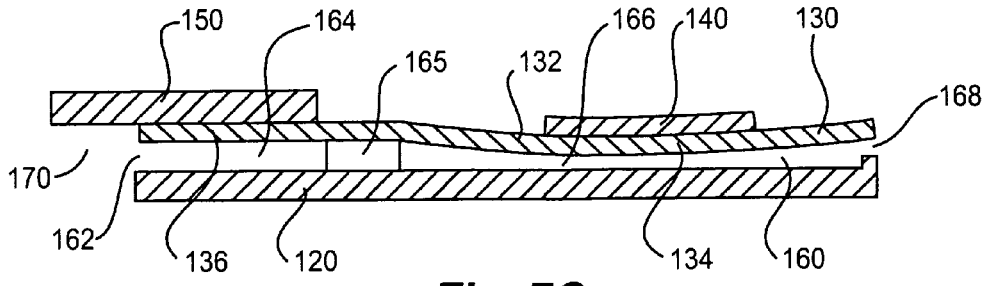

FIGS. 7A-7C illustrate one embodiment of operation of printhead assembly 12 (including printhead assembly 12'). In one embodiment, as illustrated in FIG. 7A, for operation of printhead assembly 12, flexible membrane 130 is initially in a deflected state. More specifically, first portion 134 of flexible membrane 130 is deflected inward toward fluid channel 160. In one embodiment, as described above, deflection of flexible membrane 130 results from the application of an electrical signal to actuator 140. In one embodiment, as described above, with reinforcement member 150 provided on second portion 136 of flexible membrane 130, deflection of second portion 136 of flexible membrane 130 is reduced or prevented during operation of printhead assembly 12.

Next, as illustrated in the embodiment of FIG. 7B, operation of printhead assembly 12 includes establishing a non-deflected state of flexible membrane 130. In one embodiment, discontinuing application of the electrical signal to actuator 140 produces the non-deflected state of flexible membrane 130. In one embodiment, as flexible membrane 130 returns to the non-deflected state, a negative pressure pulse (i.e., vacuum) is generated within fluid ejection chamber 166. As such, a negative pressure wave propagates through fluid channel 160 such that fluid is drawn into fluid channel 160 from fluid inlet 162 when the negative pressure wave reaches fluid inlet 162. Thus, printhead assembly 12 operates in a fill-before-fire mode. In one embodiment, the negative pressure wave is reflected from fluid inlet 162 thereby producing a reflected positive pressure wave within fluid channel 160.

Next, as illustrated in the embodiment of FIG. 7C, operation of printhead assembly 12 continues by establishing a second deflected state of flexible membrane 130. More specifically, first portion 134 of flexible membrane 130 is deflected inward toward fluid channel 160. In one embodiment, as described above, application of an electrical signal to actuator 140 produces the deflected state of flexible membrane 130. As flexible membrane 130 assumes or establishes the deflected state, a positive pressure pulse is generated within fluid ejection chamber 166. As such, a positive pressure wave propagates through fluid channel 160.

In one embodiment, timing of the positive pressure pulse is such that the positive pressure wave combines with the previously generated reflected positive pressure wave (initiated when the flexible membrane returned to the non-deflected state) to produce a combined positive pressure wave within fluid ejection chamber 166. Thus, the combined positive pressure wave propagates through fluid ejection chamber 166 such that when the combined positive pressure wave reaches fluid outlet 168, a drop of fluid is ejected from fluid outlet 168. It is understood that the extent of deflection of flexible membrane 130 illustrated in the embodiments of FIGS. 7A and 7C has been exaggerated for clarity of the invention.

By providing reinforcement member 150 on second portion 136 of flexible membrane portions 132, reinforcement member 150 prevents flexible membrane 130 from oscillating over fluid plenum 164, and ensures that the positive reflection occurs at the interface of fluid inlet 162 to fluid supply passage 170. Furthermore, providing reinforcement member 150 on second portion 136 of flexible membrane portions 132 also ensures that no compliance exists to dampen the negative pressure pulse or the reflected positive pressure pulse.

In addition to preventing flexible membrane 130 from oscillating over fluid plenum 164, reinforcement member 150 also provides an intermediary material to accommodate the differing materials (and, therefore, differing coefficients of thermal expansion) of a sub-assembly including substrate 120, flexible membrane 130, and actuators 140, and supporting structure 180 (FIGS. 5 and 6) for the sub-assembly when the sub-assembly and the supporting structure are joined together. For example, as described above, substrate 120 and flexible membrane 130 may be formed of silicon and/or glass, while supporting structure 180 may be formed of plastic. Thus, when the sub-assembly and the supporting structure are joined together, for example, by bonding under a temperature load, the plastic of the supporting structure may deform differently than the silicon and/or glass of substrate 120 and flexible membrane 130 thereby inducing stress in the silicon and/or glass. Accordingly, in one embodiment, reinforcement member 150 placed between the silicon and/or glass of substrate 120 and flexible membrane 130, and the plastic of the supporting structure helps to absorb this stress.

The architecture of fluid channels 160, as illustrated and described herein, produces low fluidic resistance and relatively even fluid flow whereby the fluid flow does not create hydraulic reflections that may impede the regular flow of fluid. As such, higher operating and drop ejection frequencies are enabled. In addition, the architecture of fluid channels 160, as illustrated and described herein, reduces crosstalk between neighboring fluid channels. Furthermore, the support of flexible membrane 130 by, for example, constriction 165, as illustrated and described herein, reduces failures caused by membrane cracking since such support reduces the stress applied to a particular, non-supported section. As such, production yield of printhead assembly 12 is increased. In addition, the fabrication of printhead assembly 12, as illustrated and described herein, allows for reduced piezo drive voltages during operation.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device, comprising:

a substrate having a fluid channel including a fluid plenum and a fluid ejection chamber communicated with the fluid plenum;

a fluid supply passage communicated with the fluid plenum of the fluid channel;

a flexible membrane supported by the substrate and extended a length of the fluid channel, wherein the flexible membrane includes a first portion extended over the fluid ejection chamber and a second portion extended over the fluid plenum;

an actuator provided on the first portion of the flexible membrane, wherein the actuator is adapted to deflect the first portion of the flexible membrane relative to the fluid channel; and a reinforcement member provided on the second portion of the flexible membrane, wherein the reinforcement member supports the second portion of the flexible membrane, has a first end positioned on the second portion of the flexible membrane, has a second end extended beyond the flexible membrane, and defines a boundary of the fluid supply passage.

2. The fluid ejection device of claim 1, wherein the flexible membrane has a first side and a second side opposite the first side, wherein the first side communicates with the fluid channel, and wherein the actuator and the reinforcement member are both provided on the second side.

3. The fluid ejection device of claim 1, wherein the fluid channel includes a fluid inlet communicated with the fluid plenum, and a fluid outlet communicated with the fluid ejection chamber, wherein the fluid supply passage communicates with the fluid inlet of the fluid channel.

4. The fluid ejection device of claim 1, wherein the reinforcement member extends over the fluid supply passage.

5. The fluid ejection device of claim 1, wherein the actuator is adapted to deflect the flexible membrane in a first direction, and the fluid ejection device is adapted to eject drops of fluid in a second direction substantially perpendicular to the first direction.

6. The fluid ejection device of claim 1, wherein the reinforcement member facilitates attachment to a supporting structure.

7. The fluid ejection device of claim 3, wherein the flexible membrane extends from the fluid inlet to the fluid outlet of the fluid channel.

8. The fluid ejection device of claim 3, wherein the reinforcement member extends over the fluid plenum of the fluid channel, beyond the flexible membrane, and beyond the fluid inlet of the fluid channel.

9. The fluid ejection device of claim 3, wherein the fluid channel includes a constriction between the fluid plenum and the fluid ejection chamber, wherein the constriction supports the flexible membrane between the first portion and the second portion of the flexible membrane.

10. The fluid ejection device of claim 3, wherein the fluid channel includes a convergence between the fluid ejection chamber and the fluid outlet.

11. The fluid ejection device of claim 3, wherein the fluid outlet communicates with an end of the substrate, and the flexible membrane extends to the end of the substrate.

12. The fluid ejection device of claim 3, wherein the flexible membrane defines a boundary of the fluid outlet.

13. The fluid ejection device of claim 9, wherein a height of the constriction is substantially equal to a depth of the fluid channel.

14. A fluid ejection device, comprising:

a substrate having a fluid channel including a fluid plenum and a fluid ejection chamber communicated with the fluid plenum;

a fluid supply passage communicated with the fluid plenum of the fluid channel;

a flexible membrane supported by the substrate and extended a length of the fluid channel, the flexible membrane including a first portion extended over the fluid ejection chamber and a second portion extended over the fluid plenum;

means for deflecting the first portion of the flexible membrane relative to the fluid channel; and means provided on the second portion of the flexible membrane for supporting the second portion of the flexible membrane, the means for supporting the second portion of the flexible membrane excluded from the first portion of the flexible membrane, extending beyond the flexible membrane, and defining a boundary of the fluid supply passage.

15. The fluid ejection device of claim 14, wherein the flexible membrane has a first side and a second side opposite the first side, wherein the first side of the flexible membrane communicates with the fluid channel, and wherein the means for deflecting the first portion of the flexible membrane and the means for supporting the second portion of the flexible membrane are both provided on the second side of the flexible membrane.

16. The fluid ejection device of claim 14, wherein the fluid channel includes a fluid inlet communicated with the fluid plenum, and a fluid outlet communicated with the fluid ejection chamber, wherein the fluid supply passage communicates with the fluid inlet of the fluid channel.

17. The fluid ejection device of claim 14, further comprising:

means within the fluid channel for supporting the flexible membrane between the first portion and the second portion of the flexible membrane.

18. The fluid ejection device of claim 14, wherein the means for deflecting the first portion of the flexible membrane is adapted to deflect the flexible membrane in a first direction, and wherein the fluid ejection device is adapted to eject drops of fluid in a second direction substantially perpendicular to the first direction.

19. The fluid ejection device of claim 16, wherein the flexible membrane extends from the fluid inlet to the fluid outlet of the fluid channel.

20. The fluid ejection device of claim 16, wherein the means for supporting the second portion of the flexible membrane extends over the fluid plenum of the fluid channel, beyond the flexible membrane, and beyond the fluid inlet of the fluid channel.

21. The fluid ejection device of claim 16, wherein the fluid outlet communicates with an end of the substrate, and the flexible membrane extends to the end of the substrate.

22. The fluid ejection device of claim 16, wherein the flexible membrane defines a boundary of the fluid outlet.

23. The fluid ejection device of claim 17, wherein the means within the fluid channel for supporting the flexible membrane comprises a constriction within the fluid channel, wherein a height of the constriction coincides with a depth of the fluid channel.

24. A method of forming a fluid ejection device, comprising:

forming a fluid channel including a fluid plenum and a fluid ejection chamber communicated with the fluid plenum in a substrate;

communicating a fluid supply passage with the fluid plenum of the fluid channel;

supporting a flexible membrane with the substrate, including extending the flexible membrane a length of the fluid channel with a first portion of the flexible membrane extending over the fluid ejection chamber and a second portion of the flexible membrane extending over the fluid plenum;

forming an actuator on the first portion of the flexible membrane, wherein the actuator is adapted to deflect the first portion of the flexible membrane relative to the fluid channel; and providing a reinforcement member on the second portion of the flexible membrane, including supporting the second portion of the flexible membrane with the reinforcement member, positioning a first end of the reinforcement member on the second portion of the flexible membrane, extending a second end of the reinforcement member beyond the flexible membrane, and defining a boundary of the fluid supply passage with the reinforcement member.

25. The method of claim 24, wherein supporting the flexible membrane with the substrate includes communicating a first side of the flexible membrane with the fluid channel, and wherein forming the actuator and providing the reinforcement member include forming the actuator and providing the reinforcement member both on a second side of the flexible membrane opposite the first side.

26. The method of claim 24, wherein forming the fluid channel in the substrate includes forming a fluid inlet, communicating the fluid plenum with the fluid inlet, communicating the fluid ejection chamber with the fluid plenum, and communicating a fluid outlet with the fluid ejection chamber, wherein communicating the fluid supply passage with the fluid plenum of the fluid channel includes communicating the fluid supply passage with the fluid inlet of the fluid channel.

27. The method of claim 26, wherein supporting the flexible membrane with the substrate includes extending the flexible membrane from the fluid inlet to the fluid outlet of the fluid channel.

28. The method of claim 26, wherein providing the reinforcement member on the flexible membrane includes extending the reinforcement member over the fluid plenum of the fluid channel, beyond the flexible membrane, and beyond the fluid inlet of the fluid channel.

29. The method of claim 26, wherein forming the fluid channel in the substrate includes forming a constriction in the fluid channel between the fluid plenum and the fluid ejection chamber, and wherein supporting the flexible membrane includes supporting the flexible membrane between the first portion and the second portion with the constriction.

* * * * *